US007503557B2

(12) United States Patent
Badham et al.

(10) Patent No.: US 7,503,557 B2
(45) Date of Patent: Mar. 17, 2009

(54) APPARATUS FOR DIVIDING A BUNDLE OF SHEET MATERIAL INTO A NUMBER OF SMALLER BUNDLES OF SHEET MATERIAL

(75) Inventors: Gary Andrew Badham, Rhondda Cynon Taff (GB); Christopher Arnold, Mid Glamorgan (GB); Richard Nicholas Steer, Mid Glamorgan (GB)

(73) Assignee: ACCO UK Limited, Aylsbury (GB)

( * ) Notice: Subject to any disclaimer, the term of this patent is extended or adjusted under 35 U.S.C. 154(b) by 304 days.

(21) Appl. No.: 11/538,300

(22) Filed: Oct. 3, 2006

(65) Prior Publication Data

US 2007/0104565 A1 May 10, 2007

(30) Foreign Application Priority Data

Oct. 4, 2005 (GB) ..... 0520104.1

(51) Int. Cl.
*B65H 1/00* (2006.01)

(52) U.S. Cl. ..... 271/145; 414/796.2

(58) Field of Classification Search ..... 271/145; 414/796, 796.2

See application file for complete search history.

(56) References Cited

U.S. PATENT DOCUMENTS 2,854,150 A * 9/1958 Shea, Jr. ..... 414/676
3,996,667 A 12/1976 Barnard
4,462,736 A * 7/1984 Jenkins ..... 414/796
4,768,912 A * 9/1988 Miura ..... 414/788.4
5,061,139 A 10/1991 Zoltner

FOREIGN PATENT DOCUMENTS

| | | |
|---|---|---|
| DE | 478198 | 6/1929 |
| EP | 0855221 | 7/1998 |
| JP | 2003073018 | 3/2003 |

OTHER PUBLICATIONS

European Search Report and Written Opinion for EP 06020854, dated Feb. 28, 2007.

* cited by examiner

*Primary Examiner*—David H Bollinger
(74) *Attorney, Agent, or Firm*—Michael Best & Friedrich LLP

(57) ABSTRACT

An apparatus for dividing a bundle of sheet material into smaller bundles includes a platform having a front and back on which the bundle is placed on an edge, a back wall against which the bundle is placed, a recess in the platform, a sliding member moveable from the front to the back of the recess along an axis and pivotable about the axis and having a portion which extends above the platform, and a finger protruding rearwardly from the sliding member offset from the axis and having a length equal to the thickness of the smaller bundles. The sliding member is moved backwards until the portion which extends above the platform abuts the bundle. It is then pivoted to lift the finger under a part of the bundle and a smaller bundle is lifted upwards from the bundle such that a user can then remove that smaller bundle.

9 Claims, 5 Drawing Sheets

APPARATUS FOR DIVIDING A BUNDLE OF SHEET MATERIAL INTO A NUMBER OF SMALLER BUNDLES OF SHEET MATERIAL

BACKGROUND TO THE INVENTION

The invention relates to an apparatus for dividing a bundle of sheet material into a number of smaller bundles of sheet material. The sheet material may be paper, card, plastic or other material or combinations of different kinds of material.

DESCRIPTION OF THE PRIOR ART

Many office machines, such as paper binders, shredders and punches, operate upon piles of paper, card, plastic or other materials, or bundles containing a mixture of such materials. For the sake of convenience, the term "material" will be used herein to encompass paper, card, plastic and other materials, and combinations of these materials.

Such machines are generally provided with openings into which material to be operated upon may be inserted. In most cases, the machines are designed to accommodate bundles of material up to a predetermined maximum total thickness. For example, a shredder may be able to shred a bundle of 30 sheets of material of a particular thickness at a time, or 20 sheets of a thicker material.

The openings into which material is introduced may be sized so as to prevent a user from inserting too thick a bundle of material. However, it is often the case that a user is able to insert a bundle of material of a greater thickness than the maximum thickness that the machine is able to accommodate. If the machine is used in such circumstances, it may become jammed, or may be damaged by the excess material. Even if damage to the machine does not occur, the material may be creased, torn or otherwise damaged by the machine, or by the user in attempting to clear a jam in the machine. Whilst this may not be a problem if, for example, the material is to be shredded, it is undesirable when the individual sheets of material are to be bound, for example, as the damage may be detrimental to the appearance of the material, possibly to the extent that the damaged sheets of material must be disposed of and new sheets prepared. This is both wasteful and time-consuming.

In an attempt to alleviate this problem, many machines are marked with the maximum number of sheets of material that can safely be accommodated. However, such markings assume that all the material used will be of standard thickness, which may not be the case. A further disadvantage of such markings is the time it takes to count out a specified number of sheets of material. Such counting is often unnecessary, as all that is required is to have a bundle of material of a thickness which can be accommodated by the machine.

It is an object of the present invention to provide a method and apparatus for dividing a document up into a number of suitably sized parts such that this is easily and reliably undertaken by the user of the binder.

SUMMARY OF THE INVENTION

According to the present invention there is provided an apparatus for dividing a bundle of sheet material into a number of smaller bundles of sheet material of a predetermined thickness comprising:

a platform having a front and a back on which in use the bundle of sheet material to be divided is placed on one of its edges;

a back wall adjacent the back of the platform against which in use the bundle of sheet material is placed;

a recess in the platform;

a sliding member moveable from the front to the back of the recess along an axis and pivotable from side to side about the axis and having a portion which extends above the platform;

a finger protruding rearwardly from the sliding member offset from the axis and having a length equal to the predetermined thickness of the smaller bundles of sheet material, and is constructed such that to divide a smaller bundle of sheet material from the bundle of sheet material the sliding member is slid backwards along the axis until the portion of the sliding member which extends above the platform abuts the bundle of sheet material, the sliding member is then pivoted about the axis to lift the finger under a part of the bundle of sheet material such that a smaller bundle of sheet material is lifted upwards and partially separated from the bundle of sheet material such that a user can then readily lift that bundle of sheet material away from the remaining sheet material.

Preferably a support is provided against which the bundle of sheet material leans whilst the apparatus is in use.

Conveniently the platform includes a portion having a surface texture which helps to prevent the bundle of sheet material slipping away from the back wall.

Preferably the apparatus further includes a spindle supported within the recess extending from the front to the back of the platform and on which the sliding member is slidably and pivotably mounted.

The sliding member conveniently includes an arm which extends laterally away from the spindle, and on which the finger is located.

The portion of the sliding member which extends above the platform may be an upstand at the rear thereof.

Conveniently the sliding member includes an indentation for receipt of the users finger.

Preferably the axis extends from the front to the back of the platform substantially perpendicularly to the back wall.

BRIEF DESCRIPTION OF THE DRAWINGS

An embodiment of an apparatus according to the invention, and the method of its use, will now be described, by way of example only, with reference to the accompanying drawings, in which.

DESCRIPTION OF THE PREFERRED EMBODIMENTS

Figure 1:
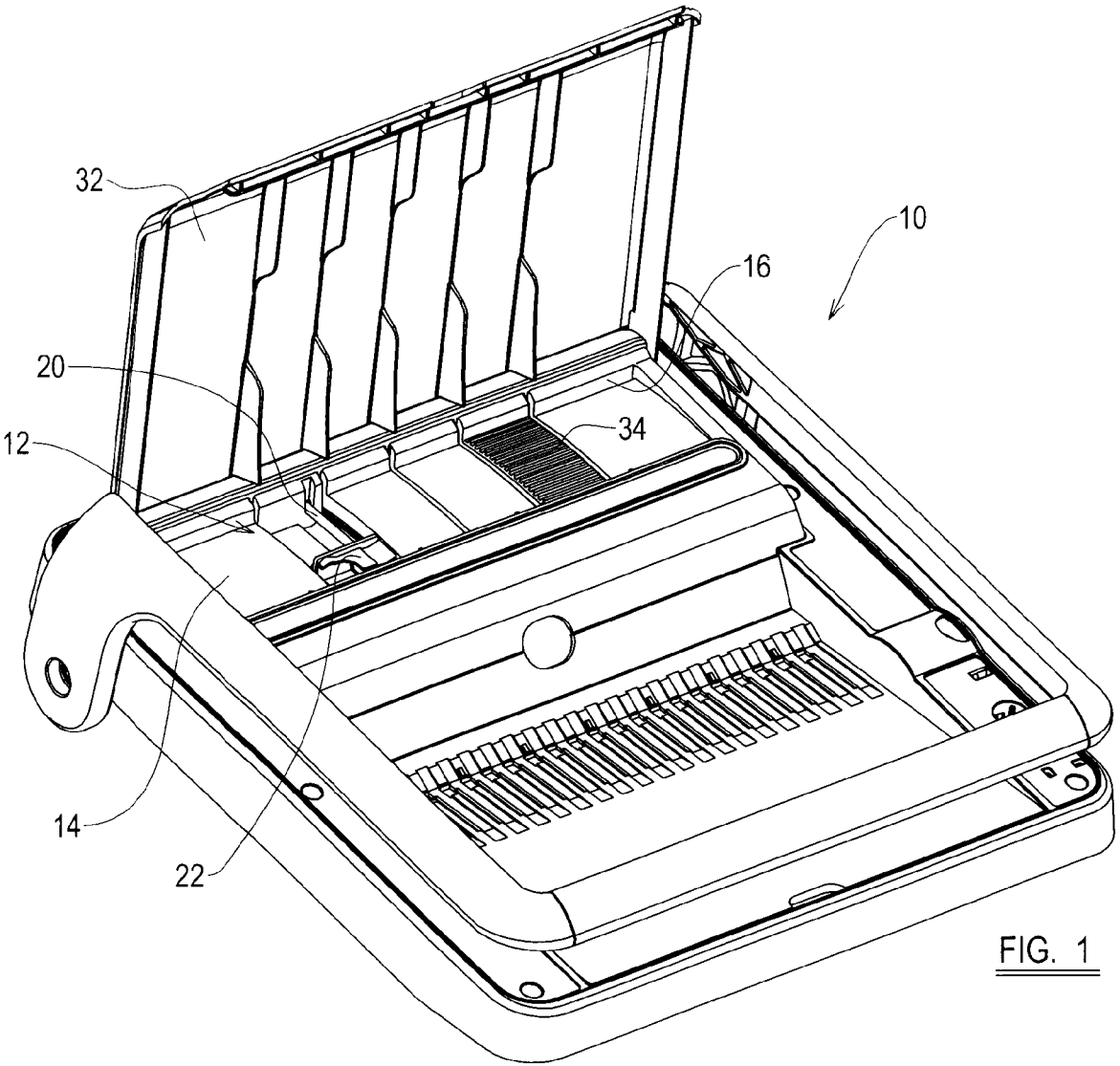
FIG. 1 is a perspective view of a document binder incorporating an apparatus according to the invention, with some parts removed for simplicity.
Figure 2:
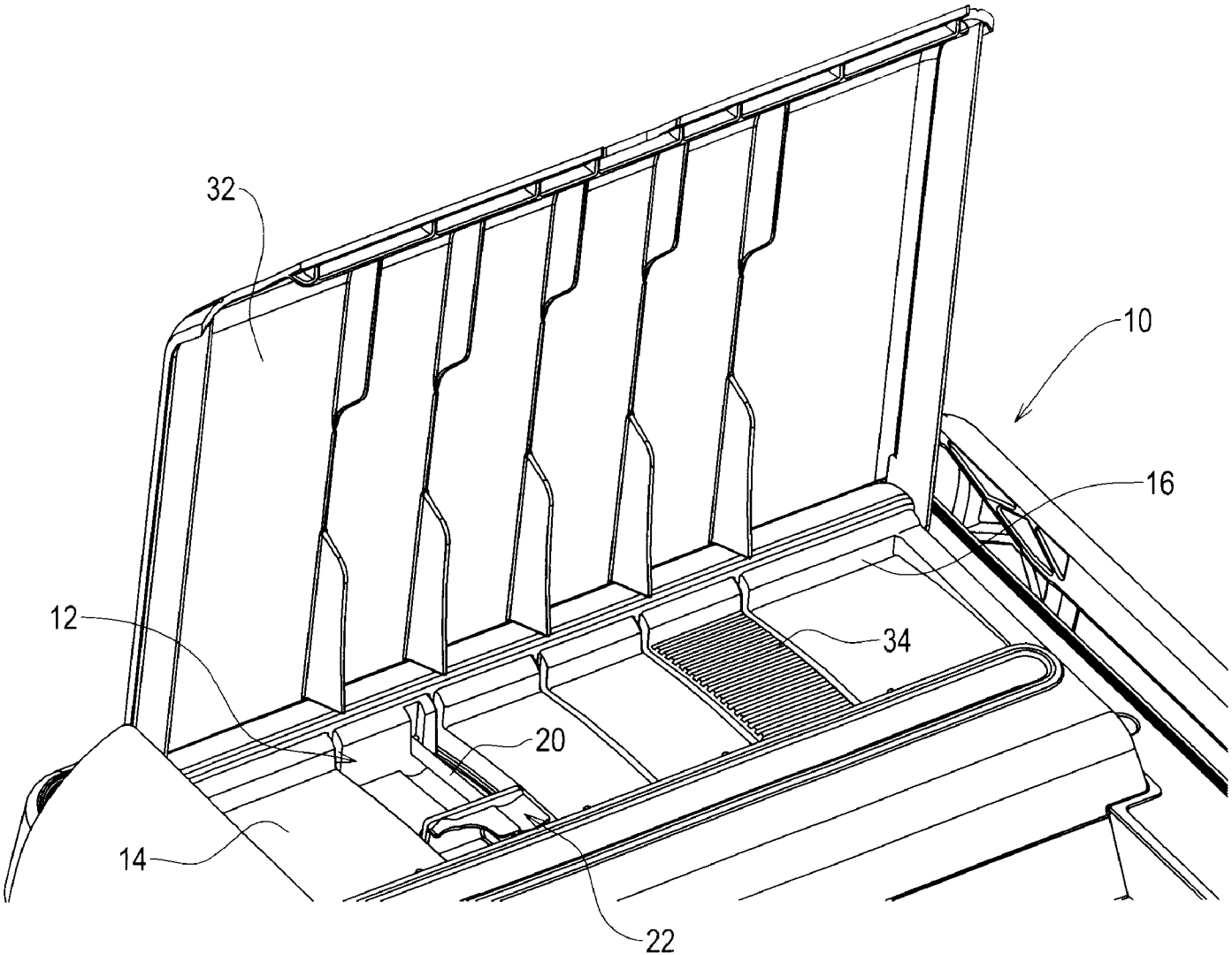
FIG. 2 is a closer perspective view of the apparatus according to the invention incorporated in the binder.
Figure 3:
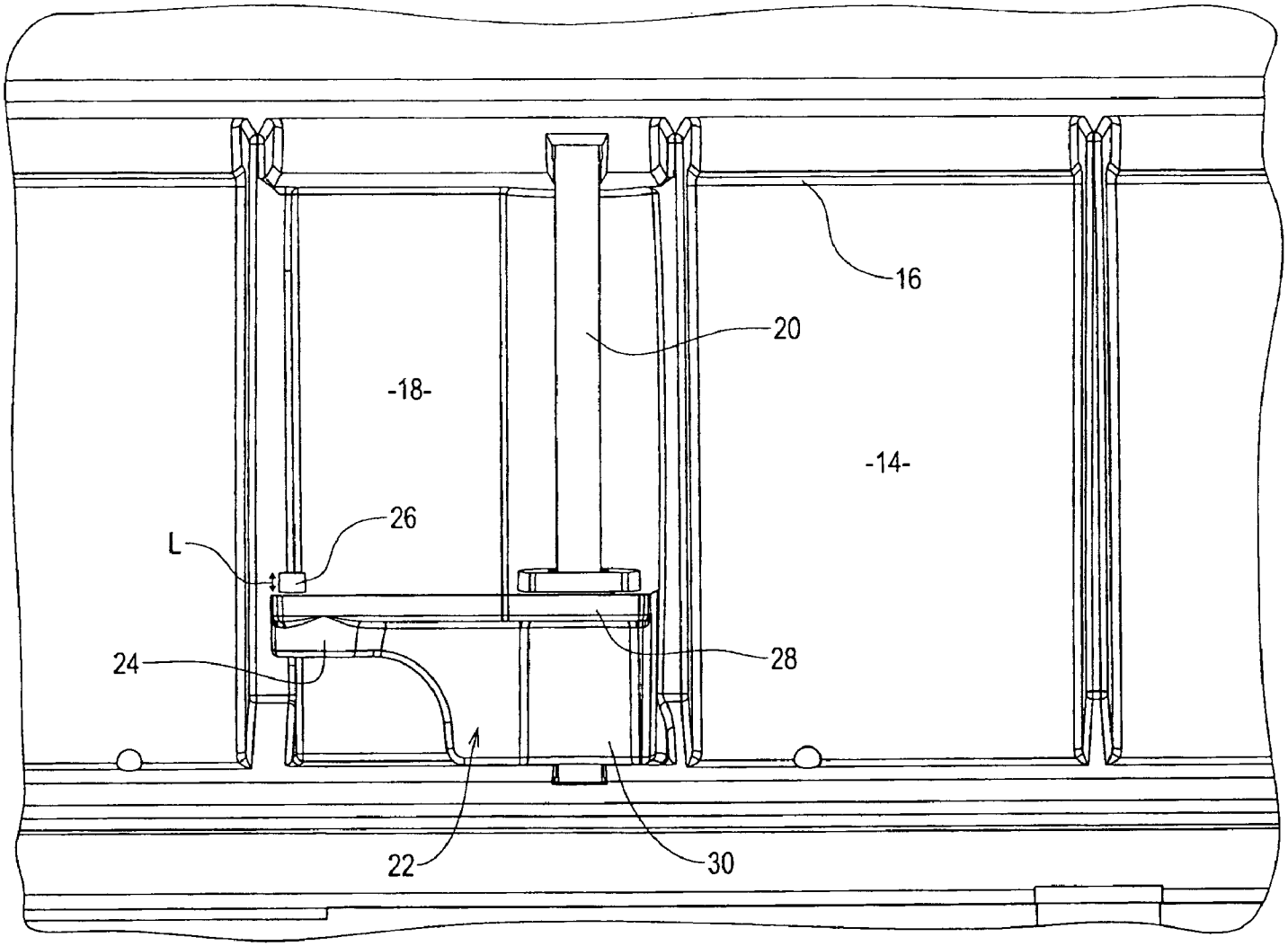
FIG. 3 is a closer plan view of the apparatus according to the invention.

Referring to the Figures, a document binder 10 includes a divider apparatus 12 which comprises a platform 14 extending across the width of the binder 10 with a back wall 16. A recess 18 is provided in the platform 14 extending substantially perpendicular to the back wall 16 for the depth of the platform 14. A spindle 20 is supported within the recess 18, above the base thereof but below the level of the platform 14 to either side of the recess 18, extending along the length of the recess 18. A sliding member 22 is provided on the spindle 20 for movement along the length of the spindle 20.

The sliding member 22 extends a short distance to one side of the spindle 20, in this case the right, and a greater distance to the other side of the spindle 20, in this case the left, which provides an arm 24 from which protrudes, parallel to the spindle 20 a finger 26. The length L of the finger 26 is the same as the thickness of bundle of sheet material which is acceptable for the relevant use, and thus the thickness of bundles into which the large bundle will be divided. Across the width of the sliding member 22 is an upstand 28 which rises above the level of the platform 14 to either side of the recess 18.

The sliding member 22 has on its upper surface above the spindle an indentation 30 for the operator's finger. If the operator applies pressure to the sliding member 22 just to the right of the spindle 20 the sliding member 22 rotates downwards on the right and upwards on the left. Thus the arm 24 rises and moves the finger 26 up also.

Figure 4:
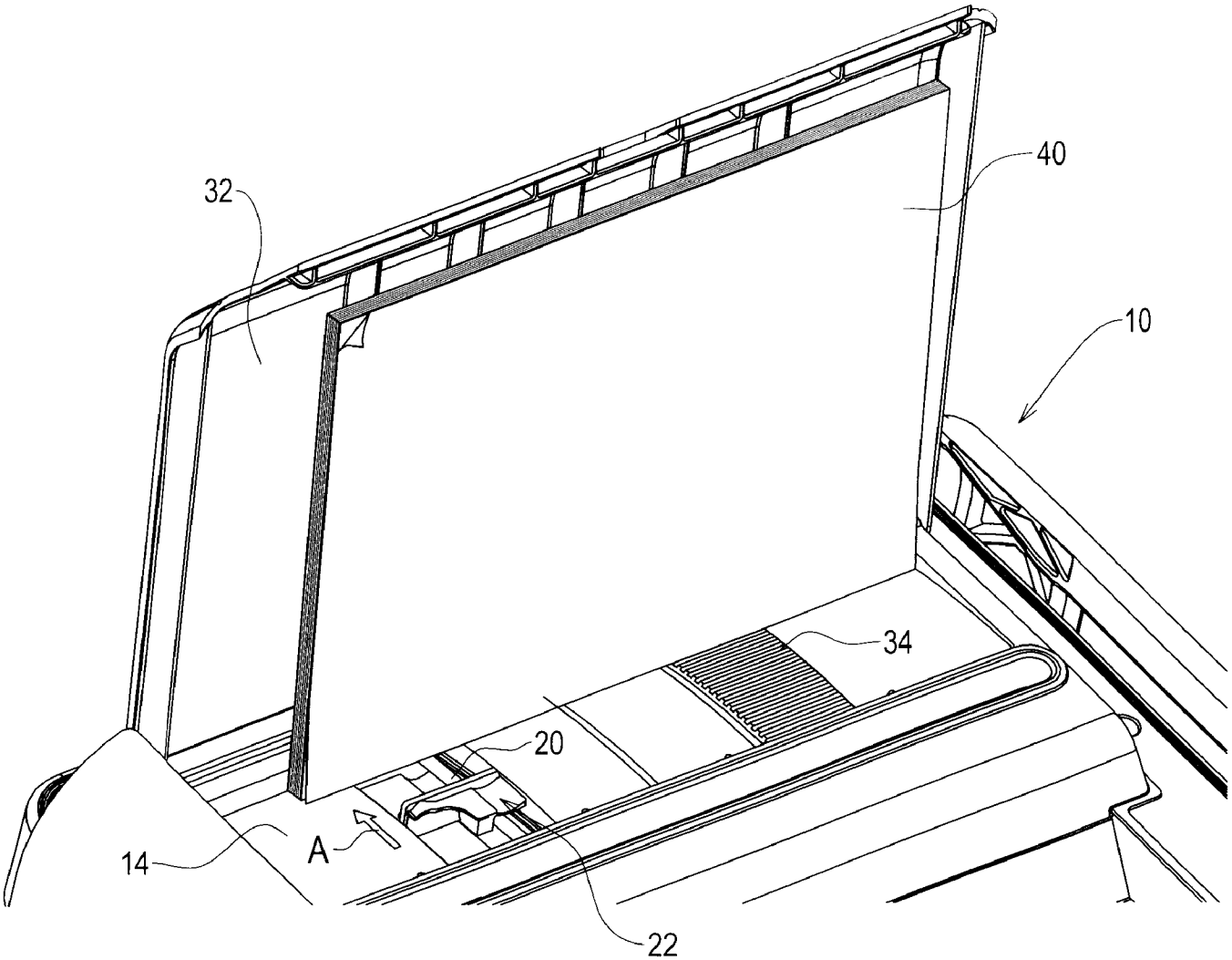
FIGS. 4 and 5 are perspective views similar to FIG. 2 but with a bundle of sheet material in place and showing the operation of the apparatus according to the invention.
Figure 5:
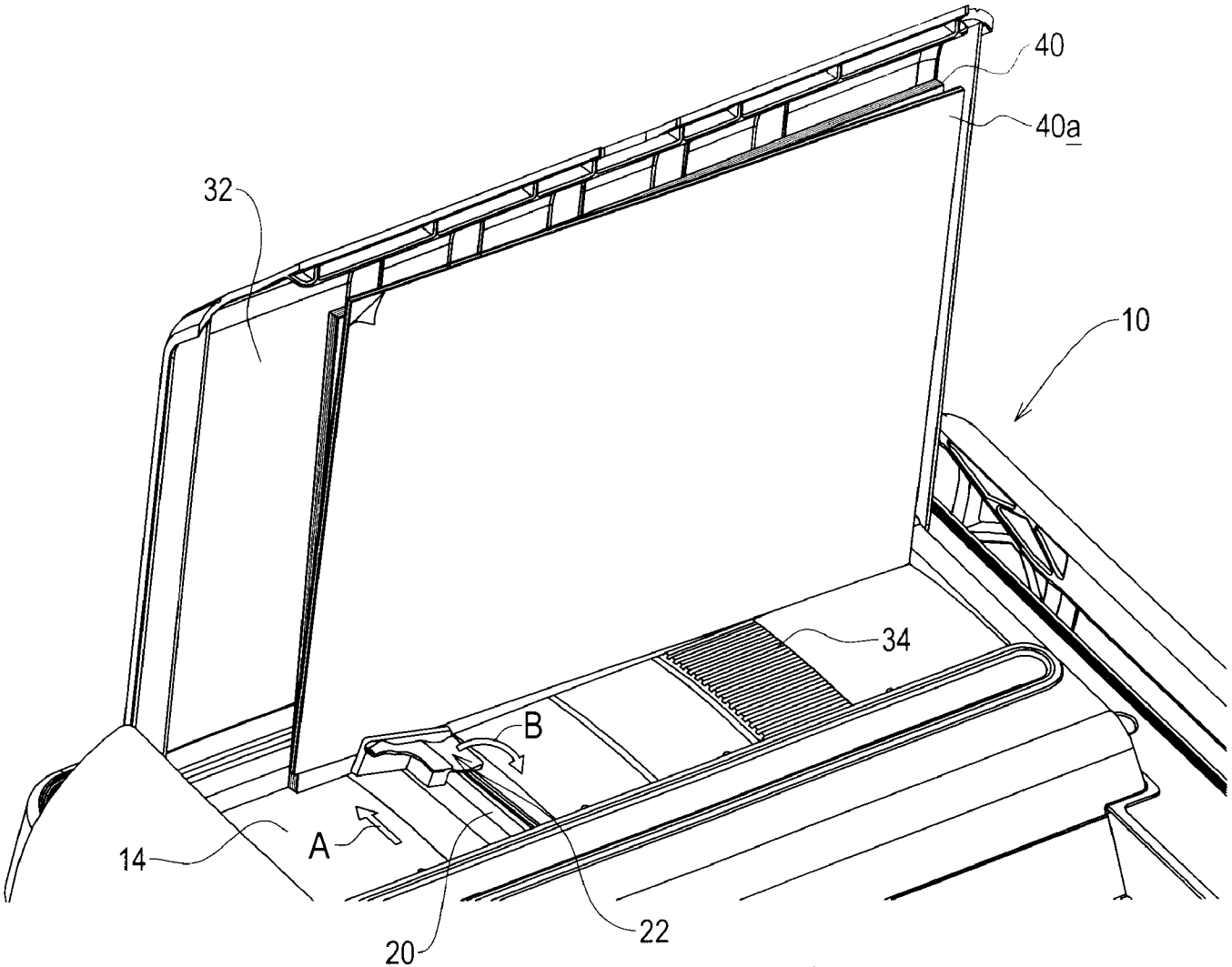

The apparatus 12 is operated as follows, with particular reference to FIGS. 4 and 5. A bundle of sheet material 40 to be separated is placed on the platform 14 against the back wall 16. A cover 32 of the binder 10 when in its raised position, as shown in the Figures, provides support for the bundle of paper above the back wall 16. An area of ridges 34 on the platform 14 helps to prevent the bundle of sheet material 40 sliding across the surface of the platform 14, which may in some embodiments of the binder 10 be slightly curved.

To divide the bundle of sheet material 40 into smaller bundles the user then slides the sliding member 22 towards the rear of the recess 18 along the spindle 20 (as indicated by arrow A) until the upstand 28 comes into contact with the bundle of sheet material 40. The user then applies pressure to the right of the sliding member 22, in the indentation 30, such that the sliding member 22 rotates on the spindle 20 (as indicated by arrow B) and as the right hand side goes downwards the left hand side goes upwards. Thus the arm 24 rises and the finger 26 rises under the most forward sheets of the bundle of sheet material 40. Thus part 40*a* of the bundle of sheet material 40 is lifted up by the finger 26 and can readily be removed from the large bundle 40 by the user to form a smaller bundle 40*a* for operating on by the binder 10. The user then repeats the operation, moving the sliding member 22 forwards until the upstand 28 abuts the large bundle of sheet material 40, and again pivoting the sliding member 22 to remove another smaller bundle of sheets 40*b*, until such time as the whole large bundle 40 has been removed in smaller bundles.

The apparatus 10 has the advantage that it divides the large bundle of sheet material 40 into smaller bundles of the correct thickness independent of the thickness of each sheet, and without the user having to count the sheets. The result is therefore both more reliable than counting and also much quicker.

The apparatus is suitable for incorporation into other machinery which needs to operate on a bundle of sheet material of predetermined thickness, such as shredders and punches.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An apparatus for dividing a bundle of sheet material into a number of smaller bundles of sheet material of a predetermined thickness comprising:

a platform having a front and a back on which, in use, the bundle of sheet material to be divided is placed on one of its edges;

a back wall adjacent the back of the platform against which, in use, the bundle of sheet material is placed;

a recess in the platform;

a sliding member moveable from the front to the back of the recess along an axis and pivotable from side to side about the axis and having a portion which extends above the platform;

a finger protruding rearwardly from the sliding member offset from the axis and having a length equal to the predetermined thickness of the smaller bundles of sheet material, and is constructed such that to divide a smaller bundle of sheet material from the bundle of sheet material the sliding member is slid backwards along the axis until the portion of the sliding member which extends above the platform abuts the bundle of sheet material, the sliding member is then pivoted about the axis to lift the finger under a part of the bundle of sheet material such that a smaller bundle of sheet material is lifted upwards and partially separated from the bundle of sheet material such that a user can then readily lift that bundle of sheet material away from the remaining sheet material.

2. An apparatus according to claim 1 wherein a support is provided against which the bundle of sheet material leans whilst the apparatus is in use.

3. An apparatus according to claim 2 wherein the platform includes a portion having a surface texture which helps to prevent the bundle of sheet material slipping away from the back wall.

4. An apparatus according to claim 1 further including a spindle supported within the recess extending from the front to the back of the platform and on which the sliding member is slidably and pivotably mounted.

5. An apparatus according to claim 4 wherein the sliding member includes an arm which extends laterally away from the spindle, and on which the finger is located.

6. An apparatus according to claim 1 wherein the portion of the sliding member which extends above the platform is an upstand at the rear thereof.

7. An apparatus according to claim 1 wherein the sliding member includes an indentation for receipt of a user's finger.

8. An apparatus according to claim 1 wherein the axis extends from the front to the back of the platform substantially perpendicularly to the back wall.

9. An apparatus according to claim 1 wherein the platform includes a portion having a surface texture which helps to prevent the bundle of sheet material slipping away from the back wall.

* * * * *